United States Patent [19]

Oren

[11] Patent Number: 4,477,979

[45] Date of Patent: Oct. 23, 1984

[54] GUN SIGHT

[76] Inventor: William H. Oren, Rd. 1, Box 71, Northfield, Vt. 05663

[21] Appl. No.: 457,561

[22] Filed: Jan. 13, 1983

[51] Int. Cl.[3] ..... F41G 1/28

[52] U.S. Cl. ..... 33/257

[58] Field of Search ..... 33/233, 259, 254, 255, 33/257, 258, 259, 247, 248; 42/1 S

[56] References Cited

U.S. PATENT DOCUMENTS

| | | | |
|---|---|---|---|
| 1,150,791 | 8/1915 | Swebilius et al. | 33/257 |
| 1,397,108 | 11/1921 | Payne | 33/258 |
| 2,127,565 | 8/1938 | King et al. | 33/257 |
| 2,406,011 | 8/1946 | Garand | 33/258 |
| 3,792,534 | 2/1974 | Lowe | 33/257 |

FOREIGN PATENT DOCUMENTS

| | | | |
|---|---|---|---|
| 141708 | 5/1980 | Fed. Rep. of Germany | 33/323 |
| 94036 | 8/1922 | Switzerland | 33/258 |

*Primary Examiner*—Harry N. Haroian

*Attorney, Agent, or Firm*—Hill, Van Santen, Steadman & Simpson

[57] ABSTRACT

In an adjustable gun sight, the improvement of a sight frame having spaced opposed tubular frame ends and an upwardly facing concave frame portion extending therebetween in longitudinal alignment, a cylindrically shaped sight pin supported by said tubular frame ends, the sight pin having a centrally located eccentrically mounted sight surface between its ends; a click device is provided for maintaining the sight pin in rotatably adjusted position with said surface being eccentrically rotatable enabling the position of the sight surface to be set in varied adjusted positions, the sight pin having a collar adjacent to one end, which collar is coactable with a shoulder on the associated tubular frame end to prohibit axial disengagement of the sight pin, the other of the opposed tubular frame ends having inside threads, an adjustable plug engaged in threaded assembly with the threads of the other tubular frame end for holding the sight pin against axial dislodgement relative to the sight frame and for enabling the sight surface to be moved longitudinally of the frame, and spring means engaged between one of the tubular frame ends and the sight pin maintaining the sight pin in a loaded, click adjusted, position.

4 Claims, 5 Drawing Figures

GUN SIGHT

The present invention concerns a new and simplified gun sight for disposition upon a gun barrel, such as a rifle or pistol.

According to important objects of my invention, the gun sight is provided with new and improved mechanism for enabling a gun sight groove or surface to be horizontally adjusted or vertically adjusted by two axially aligned adjusting screws. Both windage and distance adjustments are accomplished with a screwdriver or the like with single click type positioning of each.

Still other objects of my invention are a new and improved gun sight which can be most economically manufactured and conveniently operated with simple click-style adjusting movements.

According to important features of my invention, I have provided a new and improved adjustable gun sight which includes a sight frame mounted in the conventional dovetail slot in the gun barrel, the sight frame having spaced opposed tubular frame ends and an upwardly facing concave frame portion extending therebetween in longitudinal alignment therewith, a cylindrically shaped sight pin supported by the frame ends and having a centrally located sight notch surface eccentrically carried between its ends, and click means for maintaining the sight pin in an rotationally and axially adjusted position, with the sight surface being eccentrically rotated with the pin enabling the position of the sight surface to be set in varied adjusted positions.

Still other features of my invention concern the provision of a collar on the sight pin adjacent to one end which collar is coactable with a shoulder on one of the tubular ends to prohibit axial disengagement of the sight pin, one of the opposed tubular frame ends having inside threads, an adjustable plug engaged in threaded assembly with the threads of the tubular frame and for holding the sight pin against axial dislodgement relative to the sight frame and for enabling the sight surface to be moved longitudinally of the concave frame position, and spring means engaged between one of the tubular frame ends and the sight pin maintaining the sight pin in a loaded adjusted position.

Yet other features of my invention include a gun sight having a retaining pin engaged between the plug and the opposing end of the sight pin to prevent co-rotational movement of the plug and the sight pin.

Still further features of my invention provide a gun sight having a click means positioned between the plug and the opposing end of the sight pin enabling the sight pin to be rotated on a click basis to vary the position of the sight surface, the click means comprising a series of radially extending circumferentially spaced serrations arranged in sets with one set being positioned on one end of the pin, and another set being arranged in confronting relation thereto on the plug, and a transverse retaining pin positioned between the sets of confronting serrations and secured against rotation with the plug or sight pin for click adjustment and to provide a detent or lock, all enabling independent rotation of the sight pin and the plug so that the sight surface can be vertically adjusted by rotation of the sight pin and so that the sight groove can be longitudinally adjusted by rotation of the adjustable plug.

BRIEF DESCRIPTION OF THE DRAWINGS

Other objects, features and advantages of the invention, its organization, construction and operation will be best understood from the following detailed description taken in conjunction with the accompanying drawings illustrating a single embodiment, on which.

Figure 3:
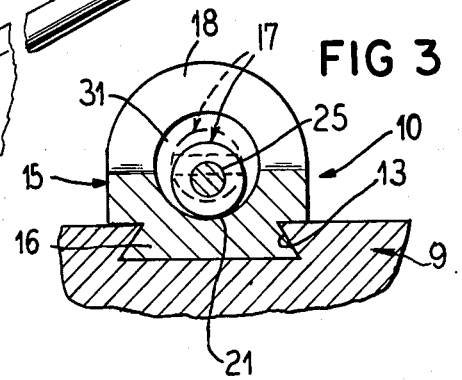
FIG. 3 is an enlarged fragmentary vertical section taken on the line III—III looking in the direction indicated by the arrows as seen in FIG. 2.

The reference numeral 8 (FIG. 1) identifies a rifle which has a rifle barrel 9 carrying an adjustable gun sight 10 which embodies important features of my invention. As stated, the gun barrel 9 has a conventional transverse dovetail slot 13. Mounted in the dovetail slot 13 is a sight frame 15 having a dovetail shaped slide 16 for sliding in mounted assembly with the dovetail slot 13 (FIG. 3). The sight frame 15 further includes an eccentrically mounted cylindrically shaped sight pin 17 which is mounted in assembly on the sight frame 15 in accordance with important features of my invention.

Before proceeding with a more detailed description of the sight pin 17, it should be noted that the sight frame 15 is uniquely constructed in being provided with spaced opposed tubular frame ends 18 and 19 which are preferably integrally formed in one piece as a part of opposite ends of a sight frame base 20. The base 20 is shaped to provide an upwardly facing concavely shaped portion or surface 21 for cradling the sight pin 17 to support the sight pin thereon. It will be seen from an examination of FIG. 2, that the sight pin 17 has its opposite ends indicated generally at 22 and 23. The ends 22 and 23 are co-axially disposed internally of the openings in the tubular ends 18 and 19 of the sight frame 15 when the sight pin is in assembly with the sight frame.

According to other features of my invention, the sight pin 17 includes a sight groove or notch surface 25 which is shown in full and dotted lines in this Figure. According to important features of my invention, I have provided new and improved adjustments for horizontally and/or vertically adjusting the sight groove or sighting surface 25 relative to the gun sight frame 15 and the barrel 9.

A device 30 is provided for maintaining the cylindrically shaped sight pin 17 in its angularly adjusted position. To control the device 30, the sight pin 17 has a collar 31 adjacent to one of its ends and which collar 31 is coactable with a shoulder 32 on one of the tubular frame ends 18 to prohibit axial disengagement of the sight pin 17 through tubular frame opening 32*a*. A spring 33 is positioned between the sight pin collar 31 and the frame shoulder 32 to maintain the sight pin in an adjusted position axially loaded toward the right as seen in FIG. 2.

The device 30 comprises in part an adjustable plug 34 which is slotted at 35 to permit rotational adjustment of the plug 34 when rotated on its external threaded surface 36 engaged with internal frame threads 37 provided on the inside surface of the tubular frame end 19.

These engaged threads 36 and 37 operate to adjust the sight pin axially relative to the sight frame 15, enabling the sight surface or groove 25 to be moved axially along the concave frame portion or surface 21 by the spring 33, into adjusted position against transverse pin 44.

Figure 2:
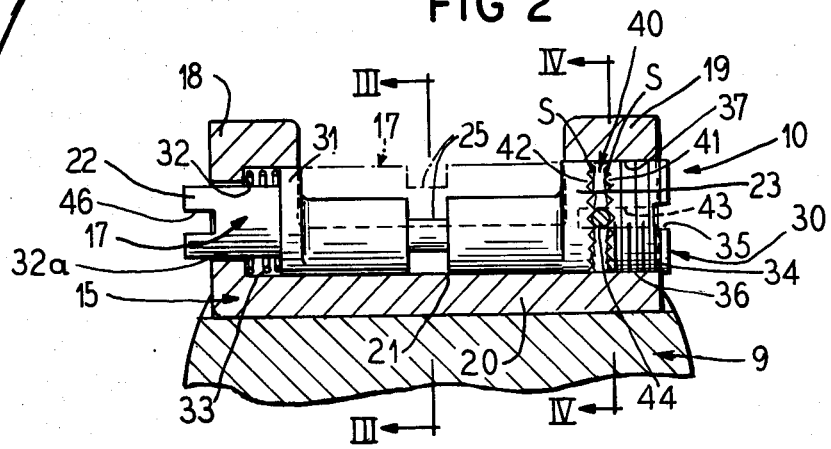
FIG. 2 is an enlarged fragmentary partially sectioned view illustrating the gun sight seen in FIG. 1.
Figure 4:
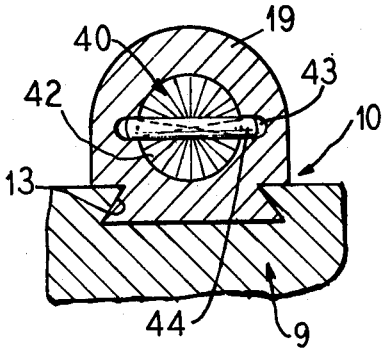
FIG. 4 is an enlarged fragmentary vertical section taken on the lines IV—IV looking in the direction indicated by the arrows as seen in FIG. 2.
Figure 5:
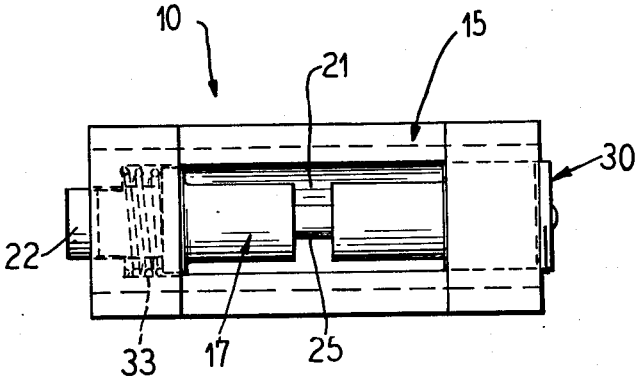
FIG. 5 is a top plan view of my gun sight.

A click device 40 is positioned between the plug 34 and the opposing pin end 23 for enabling the sight pin to be rotated to vary the eccentric position of the sight surface or groove 25, as illustrated by the full and dotted lines in FIG. 2. The click device 40 comprises a series of radially extending circumferentially spaced serrations S which are arranged in sets as indicated at 41 and 42. The sets 41 and 42 of serrations S are arranged in axially confronting relation and are maintained in spaced relation by means of a retaining pin 44 that is lodged in an axially extending pin groove 43. The pin groove 43 is slightly oversized in length with respect to the length of the pin 44 as is shown in FIG. 4. Thus, the engaged threads 36 and 37 of the plug 34 and the frame end 19 serve to hold the plug against the pin 44 which is spring biased by spring 32.

The pin 44 between the sets of serrations 41 and 42 provides a detent or lock which permits independent ratcheting rotation of the sight pin 17 and the plug 34 so that the sight surface or groove 25 can be vertically adjusted by rotation of the sight pin and so that the sight groove or surface can be longitudinally adjusted by rotation of the adjustable plug, and be retained against independent change.

In order to longitudinally adjust the pin 17, a screwdriver or similar tool, can be inserted into the slot 35 in the plug 34. As the plug 34 is rotated, it can be moved either in a direction away from or toward the shoulder 32 provided at the opposite frame end 18. The spring 33 serves to maintain the pin 17 in a spring loaded condition since it coacts with the shoulder 32, the pin 17, and the device 30. If the plug 34 is rotated clockwise, the axial position of the groove or sighting surface 25 is moved to the left in FIG. 2 and if the plug 34 is rotated in the counter-clockwise direction the groove or sighting surface 25 is moved to the right.

As the plug 34 is rotated its serrations S, or 41, are ratcheted over the pin 44. As the plug 34 is rotated, the adjustment between the serrations S in the set 42 with respect to the pin 44 remains as originally set. Where it is desired to vary the vertical position of the sighting notch or groove 25, a screwdriver is inserted into the slot 46 and turned one direction or the other depending on whether it is desired to move the sighting surface up or down. As the pin 17 is rotated, the serrations S, 42, are rotated with respect to the pin 44 while the adjustment between the pin and the set of serrations 41 remains in the position as originally set by rotation of the plug 34. Thus, it will be seen that the spring 33 and pin 44 permit limited axial displacement of the sight pin 17 during any adjustment to accommodate the new adjustment and to prevent a change in the adjustment from gun vibration or from action caused by any force other than a screwdriver at slot 35 or 46.

Figure 1:
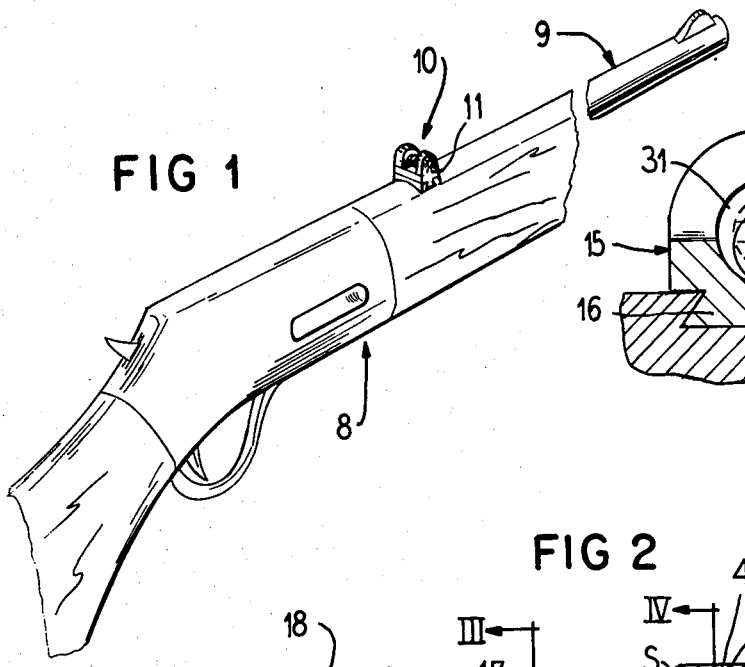
FIG. 1 is a fragmentary perspective view of a rifle having my new and improved gun sight mounted thereon.

Reference marks may be provided on the frame ends in the form of radial lines, such as shown at 11 in FIG. 1. These cooperate optically with the screwdriver slots 35, 46 to provide a reference base for indicating the amount of an adjustment as it is being made.

The sight is shown on a rifle, but it is particularly useful with hand guns with their shorter sight radius, since the range of vertical adjustment is limited by the diameter of the sight pin 31. In either use, the sight is simple to make and to use and provides a substantial improvement in the art.

I claim:

1. In an adjustable gun sight, having a sight frame for mounting on a gun barrel, said sight frame having spaced opposed cylindrical frame ends with an upwardly facing cut out concave frame portion extending therebetween in longitudinal alignment therewith, a rotatable cylindrically shaped sight pin supported by said frame ends, the sight pin having a centrally located eccentrically mounted sight surface between its ends, means for rotatably adjusting said sight pin, and click means for maintaining the sight pin in an eccentricall adjusted position, said sight pin having a collar adjacent to one end which collar is coactable with a shoulder on the corresponding tubular frame end to prohibit axial disengagement from the frame of the sight pin, the other of the opposed tubular frame ends having inside threads, and an adjustable plug engaged in threaded assembly with the threads of the said other tubular frame end for holding the sight pin against axial dislodgement relative to the sight frame and for enabling the sight surface to be adjustably moved longitudinally of the frame, and spring means biasing the sight pin longitudinally toward said plug to provide a spring loaded adjusted position.

2. The gun sight of claim 1 further characterized in that the click means includes a nonrotatable element positioned between the plug and the opposing end of the sight pin and movable axially of the tubular frame enabling the sight pin to be rotated to vary the vertical position of the sight surface without affecting adjustment of the plug and vice versa.

3. The gun sight of claim 2 wherein said nonrotatable click element comprises a transverse retaining pin engaged between the plug and the opposing end of the sight pin to prohibit corotational movement of the plug with the sight pin.

4. The gun sight of claim 1 further characterized by the click means comprising a series of radially extending circumferentially spaced serrations arranged in sets with one set being positioned on one end of said sight pin and another set being arranged in confronting relation on the opposing end of said plug, and a transverse retaining pin positioned between said sets of confronting serrations and secured against rotation but allowed to move axially of the tubular frame for click adjustment in the serrations of said sets to provide a detent for enabling independent rotation of said sight pin and said plug so that the sight surface can be vertically adjusted by rotation of the sight pin and the sight surface can be longitudinally adjusted by rotation of said adjustable plug without either adjustment changing the other.

* * * * *